US008456369B2

(12) United States Patent
Chen et al.

(10) Patent No.: US 8,456,369 B2
(45) Date of Patent: Jun. 4, 2013

(54) DIPOLE ANTENNA AND PORTABLE COMPUTER UTILIZING THE SAME

(75) Inventors: Huang-Chih Chen, Taipei Hsien (TW); Chia-Huang Shen, Taipei Hsien (TW); Yung-Jinn Chen, Taipei (TW)

(73) Assignee: Wistron NeWeb Corp., Hsinchu (TW)

( * ) Notice: Subject to any disclaimer, the term of this patent is extended or adjusted under 35 U.S.C. 154(b) by 464 days.

(21) Appl. No.: 12/765,778

(22) Filed: Apr. 22, 2010

(65) Prior Publication Data

US 2011/0102273 A1 May 5, 2011

(30) Foreign Application Priority Data

Oct. 29, 2009 (TW) ..... 98136627 A

(51) Int. Cl.
*H01Q 1/28* (2006.01)

(52) U.S. Cl.
USPC ..... 343/702

(58) Field of Classification Search
USPC ..... 343/702, 846, 848, 850, 853, 700 MS
See application file for complete search history.

(56) References Cited

U.S. PATENT DOCUMENTS 6,809,689 B1 10/2004 Chen
6,861,986 B2 * 3/2005 Fang et al. ..... 343/700 MS
6,906,678 B2 6/2005 Chen
8,134,517 B2 * 3/2012 Wang et al. ..... 343/846
8,155,698 B2 * 4/2012 Roberts et al. ..... 455/556.1
2004/0183727 A1 * 9/2004 Choi ..... 343/700 MS
2005/0140553 A1 * 6/2005 Kuramoto ..... 343/702
2011/0234470 A1 * 9/2011 Chen ..... 343/895

FOREIGN PATENT DOCUMENTS

TW M296492 8/2006

OTHER PUBLICATIONS

Taiwan Patent Office, Office Action, Patent Application Serial No. 098136627, Jan. 18, 2012, Taiwan.

* cited by examiner

*Primary Examiner* — Huedung Mancuso

(57) ABSTRACT

A dipole antenna is provided. The dipole antenna includes a signal line, a ground line, a substrate, a first radiation element and a second radiation element. The substrate includes a first surface and a second surface, wherein the first surface is opposite to the second surface. The first radiation element is disposed on the first surface and electrically connected to the signal line, wherein the first radiation element comprises a first connection portion and a first extending portion, the first extending portion comprises a first bending portion, the first bending portion forms a first section and a second section on the first extending portion, and the first section is connected to the first connection portion. The second radiation element is disposed on the second surface and electrically connected to the ground line, wherein the second radiation element comprises a second connection portion.

22 Claims, 15 Drawing Sheets

DIPOLE ANTENNA AND PORTABLE COMPUTER UTILIZING THE SAME

CROSS REFERENCE TO RELATED APPLICATIONS

This application claims priority of Taiwan Patent Application No. 098136627, filed on Oct. 29, 2009, the entirety of which is incorporated by reference herein.

BACKGROUND OF THE INVENTION

1. Field of the Invention

The present invention relates to a dipole antenna, and in particular relates to a dipole antenna with reduced dimensions.

2. Description of the Related Art

FIG. 1*a* shows a conventional dipole antenna 1, comprising a first arm 10, a second arm 20, a signal line 31 and a ground line 32. The signal line 31 is electrically connected to the first arm 10. The ground line 32 is electrically connected to the second arm 20. The dipole antenna 1 transmits a wireless signal. The wireless signal has a wave length λ.

Conventionally, the lengths of the first arm 10 and the second arm 20 are λ/4. Thus, decreasing the dimensions of the conventional dipole antenna 1 is difficult. Also, with reference to FIG. 1*b*, conventional dipole antennas 1 have a housing 40, and the housing 40 covers the first arm 10, the second arm 20, the signal line 31 and the ground line 32. Thus, when the conventional dipole antenna 1 is disposed on a top edge of a portable computer (for example, a notebook computer), the appearance of the portable computer is influenced. Meanwhile, when the conventional dipole antenna 1 is disposed on a side edge of the portable computer, signal transmission thereof is deteriorated. Specifically, the circuit board of the portable computer interferes with electrical fields of the dipole antenna 1.

BRIEF SUMMARY OF THE INVENTION

A detailed description is given in the following embodiments with reference to the accompanying drawings.

A dipole antenna is provided. The dipole antenna includes a signal line, a ground line, a substrate, a first radiation element and a second radiation element. The substrate includes a first surface and a second surface, wherein the first surface is opposite to the second surface. The first radiation element is disposed on the first surface and electrically connected to the signal line, wherein the first radiation element comprises a first connection portion and a first extending portion, the first extending portion comprises a first bending portion, the first bending portion forms a first section and a second section on the first extending portion, and the first section is connected to the first connection portion. The second radiation element is disposed on the second surface and electrically connected to the ground line, wherein the second radiation element comprises a second connection portion.

Utilizing the embodiment of the invention, the dimension of the dipole antenna on a Z axis (vertical direction) can be reduced. Therefore, the dipole antenna of the invention can be embodied in the housing of the portable computer. In an embodiment of the invention, the dipole antenna does not protrude from a surface of the housing of the portable computer. Thus the dipole antenna of the invention does not influence appearance of the portable computer like conventional dipole antennas.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1B:
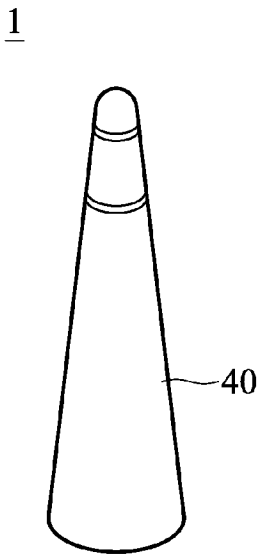
FIG. 1b (PRIOR ART)
FIG. 1*b* shows an appearance of the conventional dipole antenna.
Figure 1A:
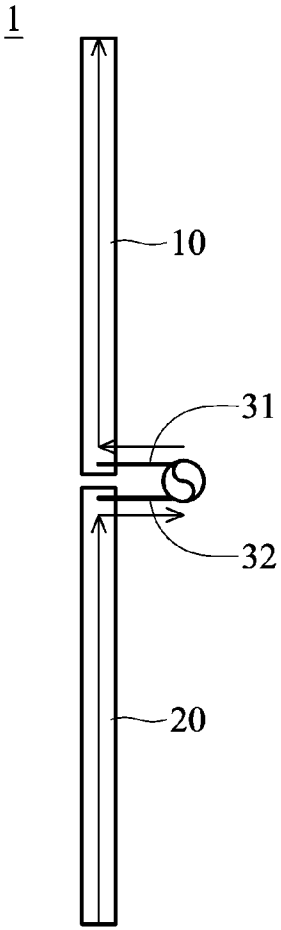
FIG. 1a (PRIOR ART)
FIG. 1*a* shows a conventional dipole antenna.
Figure 2A:
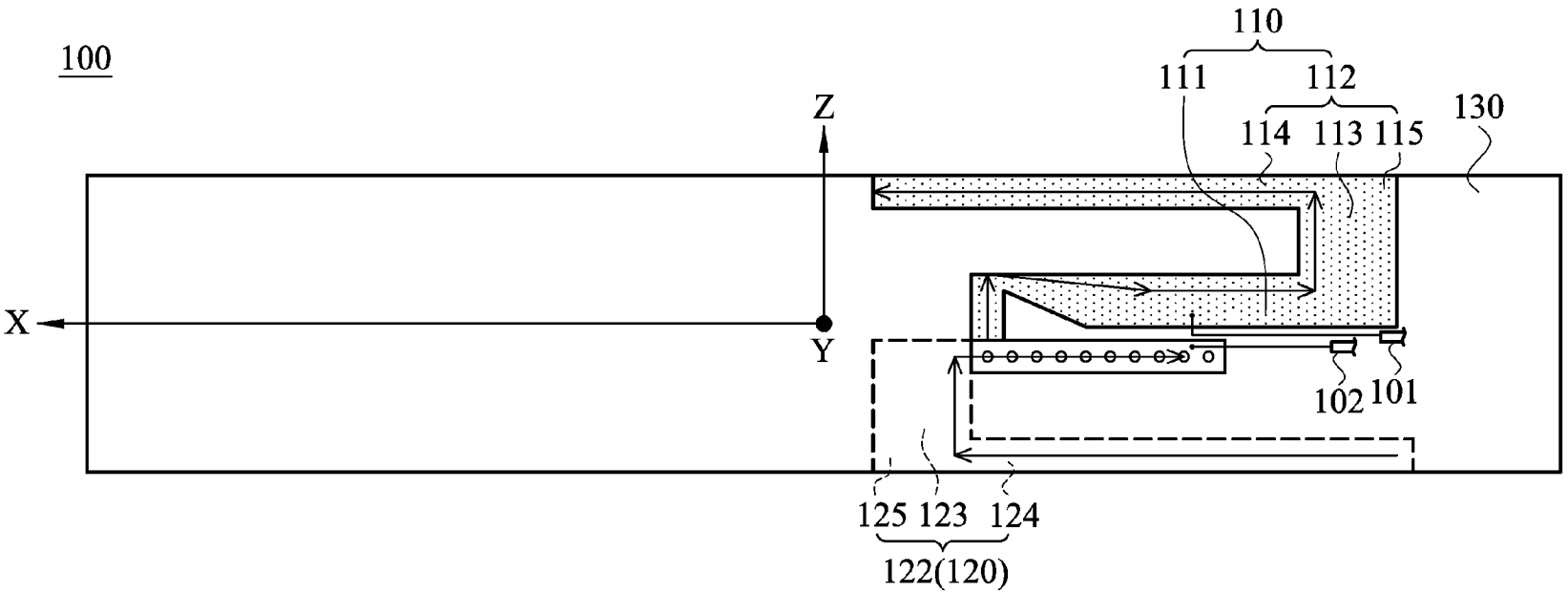
FIG. 2*a* shows a dipole antenna of a first embodiment of the invention.
Figure 2B:
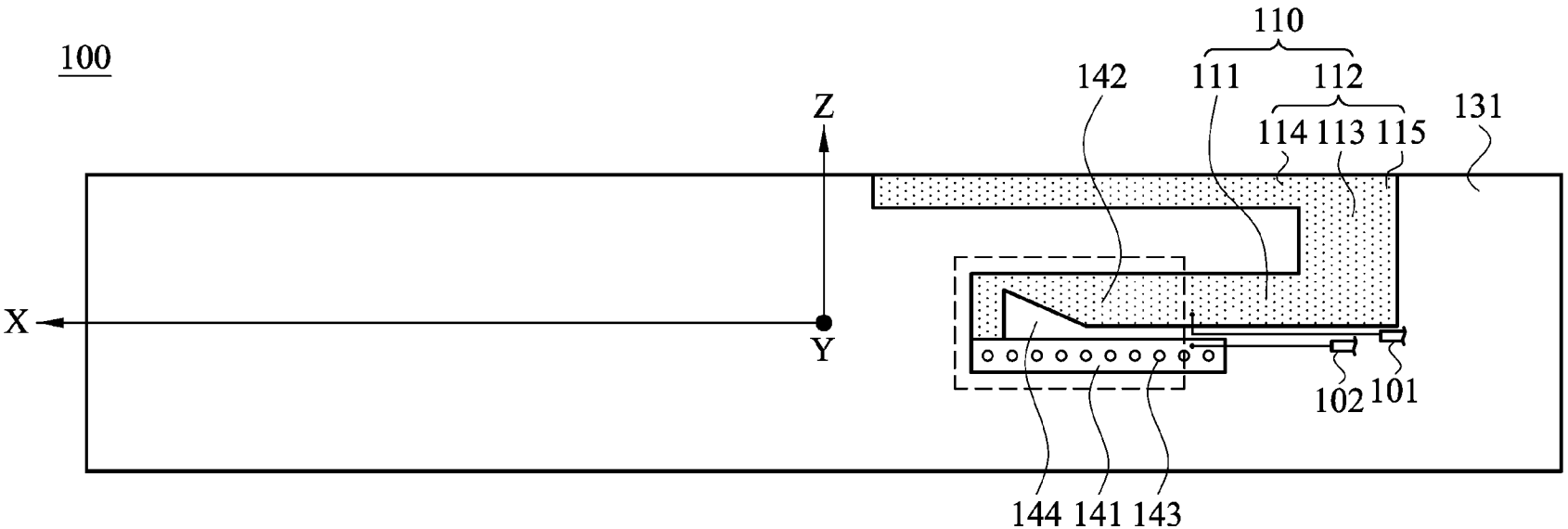
FIG. 2*b* shows a detailed structure of a first radiation element of the first embodiment.
Figure 2C:
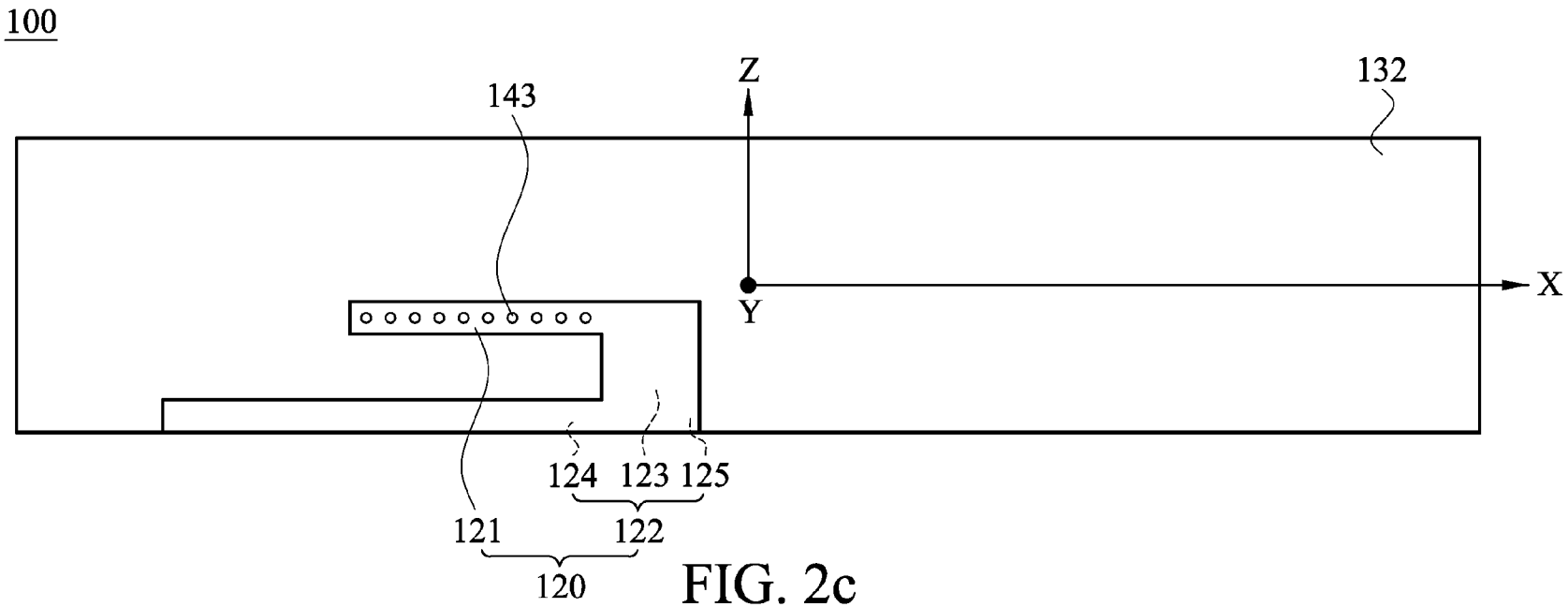
FIG. 2*c* shows a detailed structure of a second radiation element of the first embodiment.

FIGS. 2*a*, 2*b* and 2*c* show a dipole antenna 100 of a first embodiment of the invention, comprising a signal line 101, a ground line 102, a substrate 130, a first radiation element 110, a second radiation element 120, a third connection portion 141 and a short element 142. The substrate 130 includes a first surface 131 and a second surface 132. The first surface 131 is opposite to the second surface 132. The third connection portion 141 and the short element 142 are disposed on the first surface 131.

The first radiation element 110 is disposed on the first surface 131, and is electrically connected to the signal line 101. The first radiation element 110 comprises a first connection portion 111 and a first extending portion 112. The first extending portion 112 has a first bending portion 115. The first bending portion 115 forms a first section 113 and a second section 114 on the first extending portion 112. The first section 113 is connected to the first connection portion 111, and the second section 114 extends toward a first direction (X).

The second radiation element 120 is disposed on the second surface 132 and electrically connected to the ground line 102. The second radiation element 120 has a second connection portion 121 and a second extending portion 122. The second extending portion 122 has a second bending portion 125. The second bending portion 125 forms a third section 123 and a fourth section 124 on the second extending portion 122. The third section 123 is connected to the second connection portion 121, and the fourth section 124 extends toward a second direction (−X). The second direction (−X) is opposite to the first direction (X). An extending direction (Z) of the first section 113 is opposite to an extending direction (−Z) of the third section 123.

The first radiation element 110 is U shaped and a first opening thereof faces a first opening direction (first direction X), the second radiation 120 element is U shaped and a second opening thereof faces a second opening direction (second direction −X), and the first opening direction is opposite to the second opening direction.

The short element 142 is connected to the first connection portion 111 and the third connection portion 141. The first connection portion 141 is parallel to the second connection portion 121. The third connection portion 141 is electrically connected to the second connection portion 121 through holes 143. The ground line 102 is connected to the third connection portion 141. A groove 144 is formed between the third connection portion 141 and the short element 142.

In this embodiment, a shape of the first extending portion 112 is substantially identical to a shape of the second extending portion 122. An orientation of the second extending portion 122 on an X-Z plane is 180° different from an orientation of the first extending portion 112 on the X-Z plane. In a modified embodiment, the shape of the first extending portion 112 can differ from the shape of the second extending portion 122 to modify resistance matching and bandwidth of the dipole antenna 100.

A line width of the first section 113 is greater than a line width of the second section 114, and a line width of the third section 123 is greater than a line width of the fourth section 124.

The first connection portion 111 is parallel to the second section 114. The first connection portion 111 extends toward the first direction (X). The second connection portion 121 is parallel to the fourth section 124. The second extending portion 121 extends toward the second direction (−X).

With reference to FIG. 2*a*, utilizing the embodiment of the invention, the dimension of the dipole antenna on a Z axis (vertical direction) can be reduced. Therefore, the dipole antenna of the invention can be embodied in the housing of the portable computer. In the embodiment of the invention, the dipole antenna does not have to protrude from a surface of the housing of a portable computer, and thus, appearance of the portable computer is not influenced.

Figure 3A:
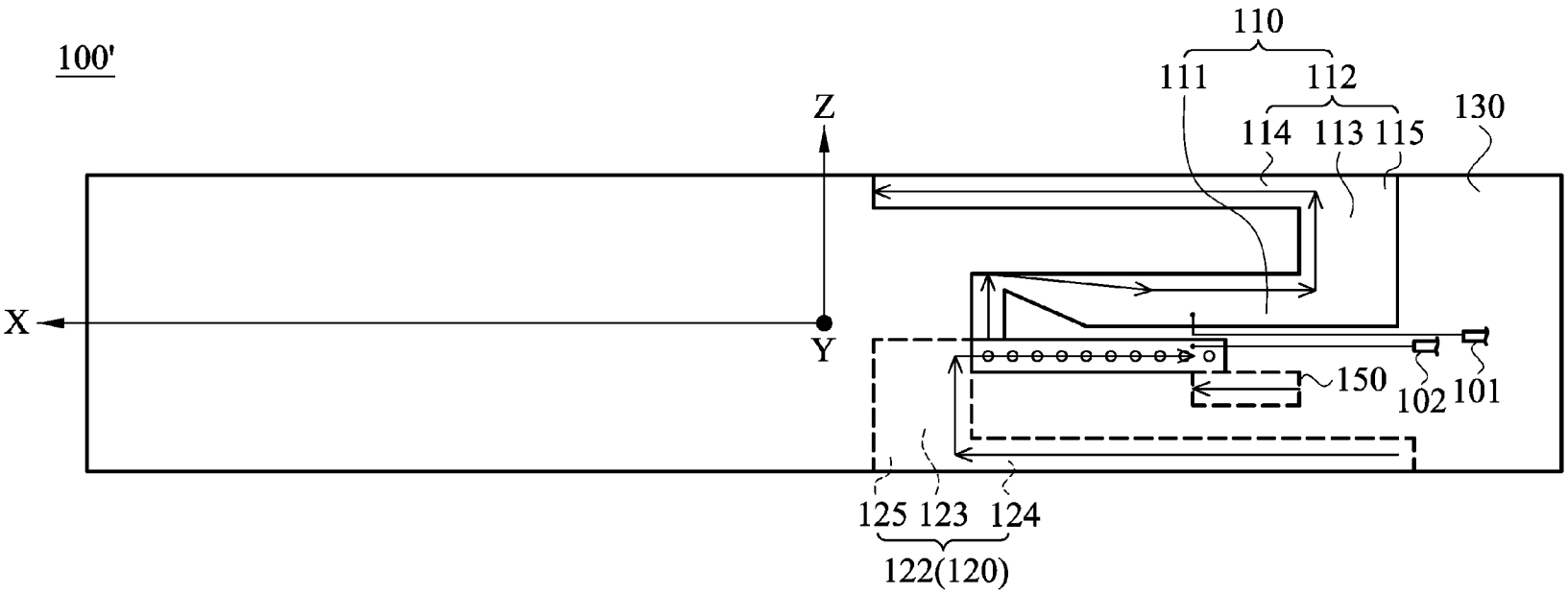
FIG. 3*a* shows a dipole antenna of a second embodiment of the invention.
Figure 3B:
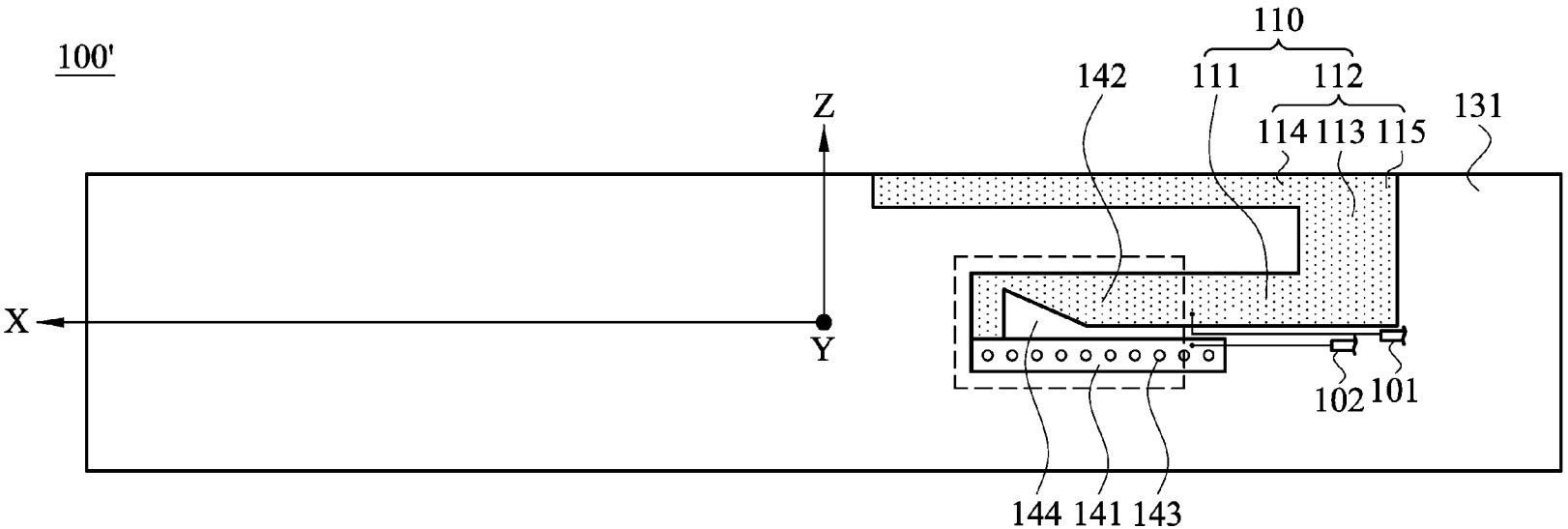
FIG. 3*b* shows a detailed structure of a first radiation element of the second embodiment.
Figure 3C:
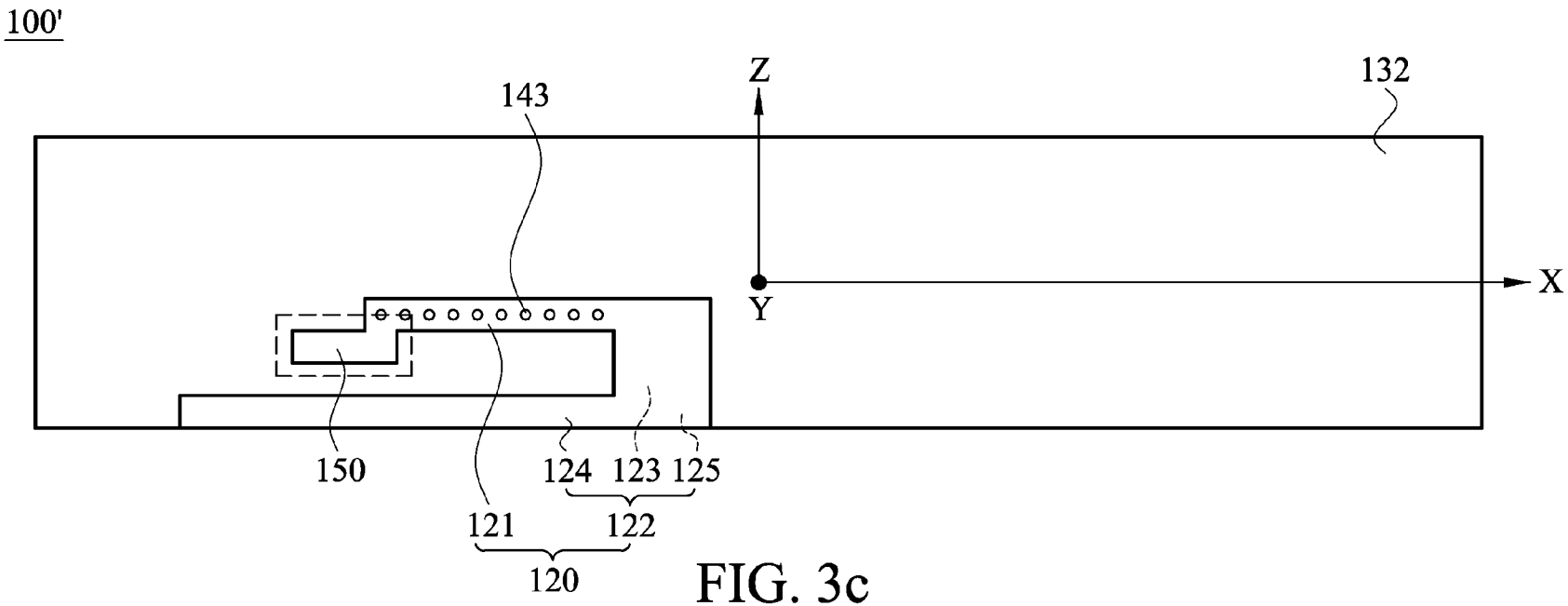
FIG. 3*c* shows a detailed structure of a second radiation element of the second embodiment.

FIGS. 3*a*, 3*b* and 3*c* show a dipole antenna 100' of a second embodiment of the invention. The characteristic of the second embodiment is that the dipole antenna 100' further comprises a parasitical element 150. The parasitical element 150 is connected to the second connection portion 121, and extends toward the second direction (−X). The parasitical element 150 is utilized as a resonance path for high frequency signals allowing the dipole antenna 100' to provide two resonance states (high frequency and low frequency). A length of the parasitical element 150 is shorter than $\lambda_{high}/4$, wherein $\lambda_{high}$ is a wavelength of the high frequency signal of the dipole antenna 100'. Additionally, the parasitical element 150 can be modified to control resistance matching.

Figure 4:
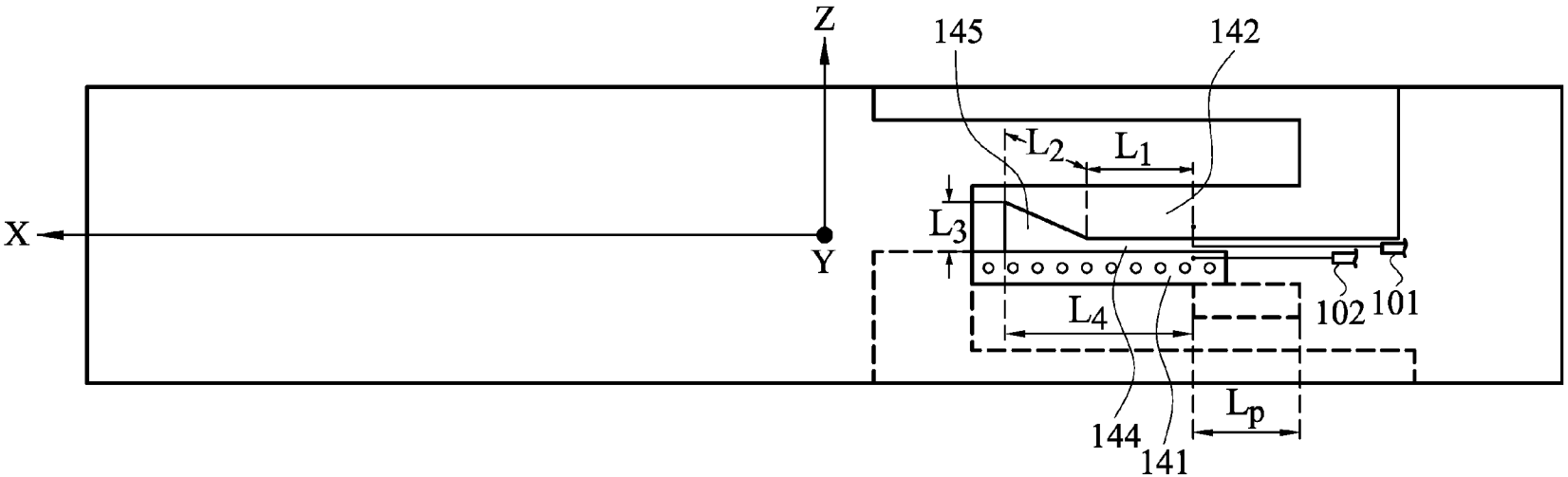
FIG. 4 shows a current path length $L_T$ of the second embodiment.
Figure 5:
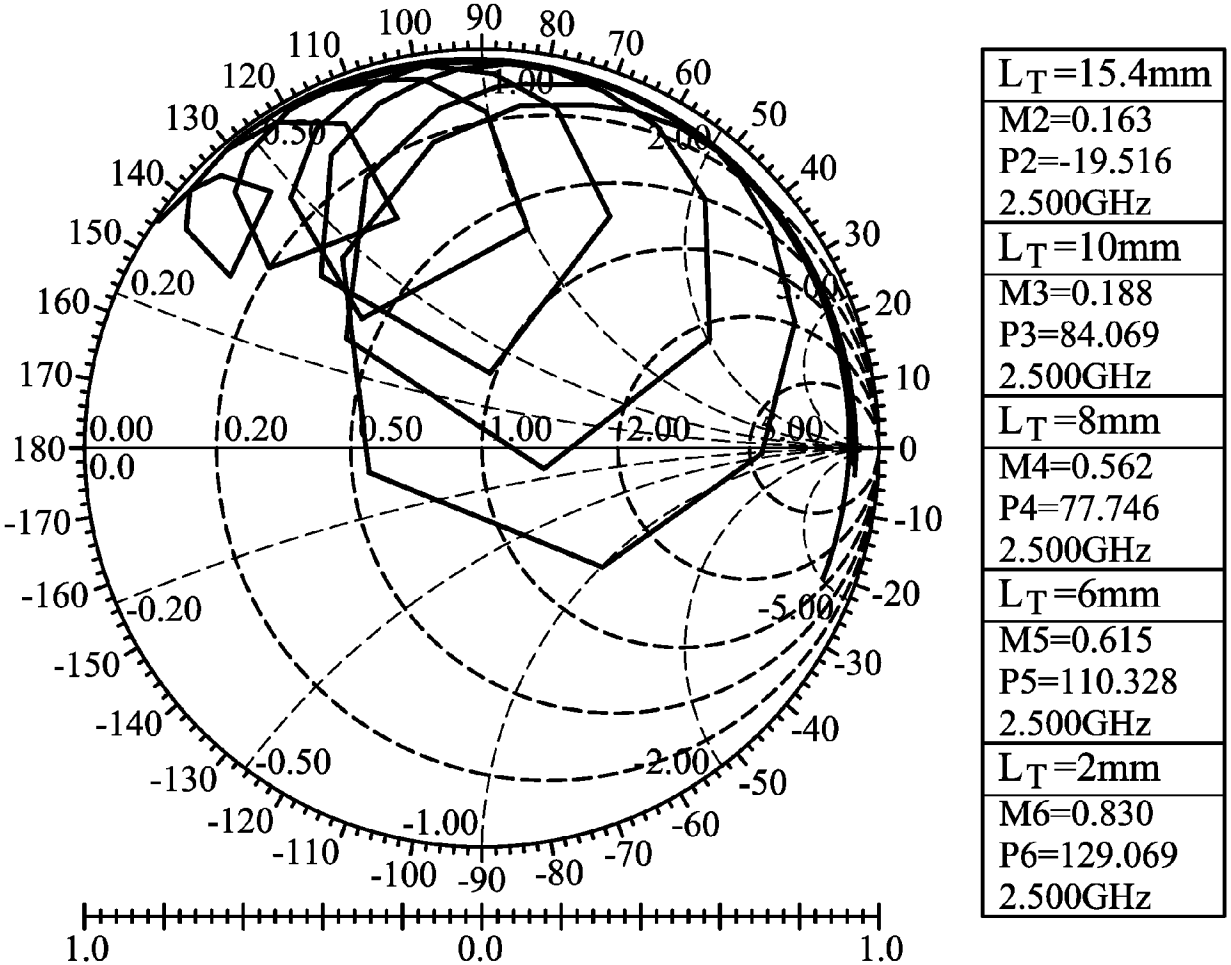
FIG. 5 shows a Smith Chart under different current path lengths $L_T$.

With reference to FIG. 4, the groove 144 is formed between the third connection portion 141 and the short element 142. A current path travels along the edge of the groove 144. The current path has a current path length $L_T$. The current path length $L_T$ is equal to the sum of the length $L_1$, the length $L_2$, the length $L_3$ and the length $L_4$. Resistance matching can be modified by changing the current path length $L_T$. FIG. 5 shows a Smith Chart under different current path lengths $L_T$. In this embodiment, when the current path length $L_T$ is 15.4 mm, a resonance point is located on a line of 50Ω, and the dipole antenna 100' has best resistance matching. In the embodiment of the invention, the current path length $L_T$ is changed by forming a recess 145 on the short element 142. The recess 145 is located on an edge of the groove 144. In this embodiment, a hypotenuse is formed on the edge of the short element 142 to form the recess 145. The recess 145 is triangular. In the embodiment of the invention, the shape of the groove between the third connection portion 141 and the short element 142 can be modified to change current path length and resistance matching effect.

Figure 6A:
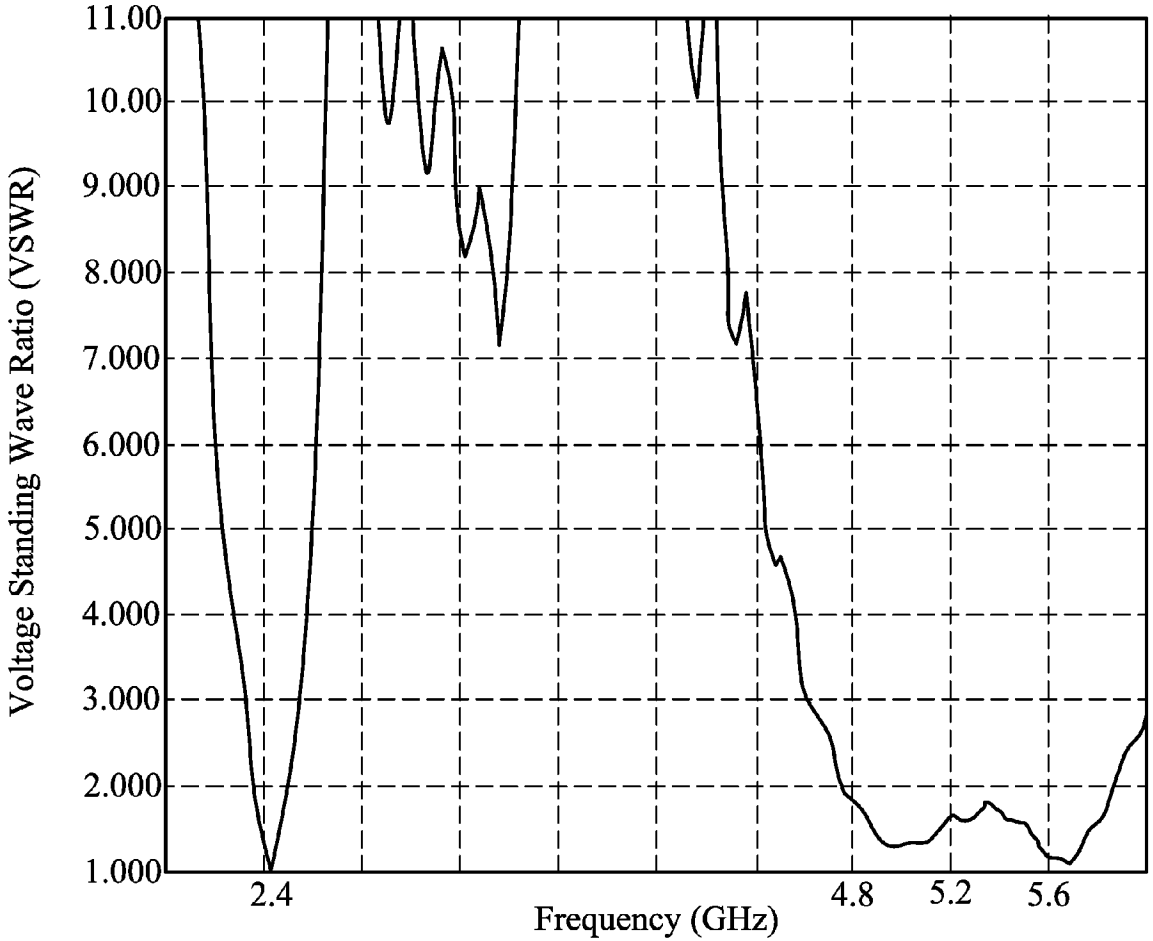
FIG. 6*a* shows the Voltage Standing Wave Ratio (VSWR) of the dipole antenna of the second embodiment.
Figure 6B:
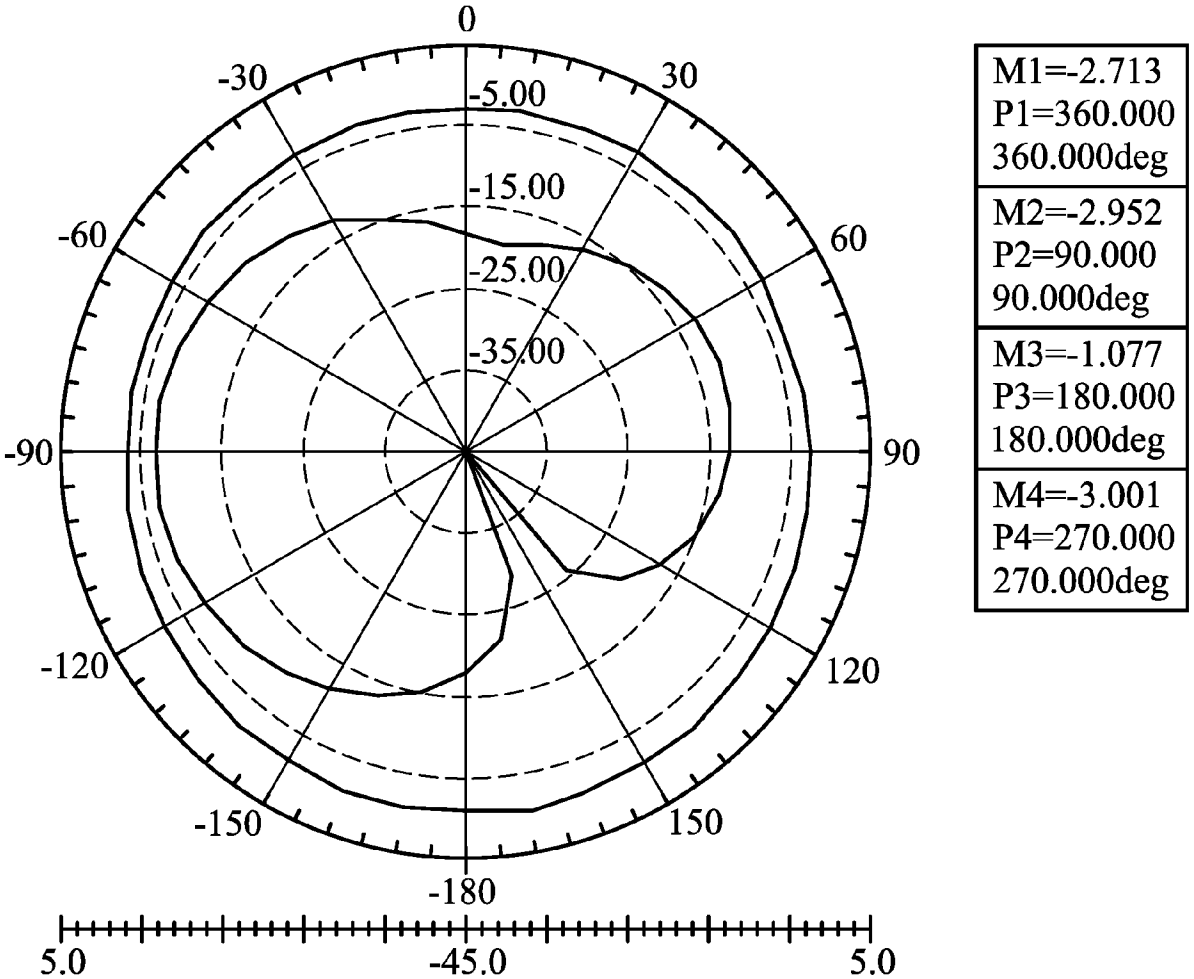
FIG. 6*b* shows an X-Y plane divergence field of the dipole antenna of the second embodiment.

FIG. 6*a* shows the Voltage Standing Wave Ratio (VSWR) of the dipole antenna 100'. The dipole antenna 100' of the embodiment can transmit signals with frequency between 2.4 GHz to 2.45 GHz (low frequency signal) and between 4.8 GHz to 5.8 GHz (high frequency signal). However, described transmission bands do not limit the invention. The transmission band of the invention can be modified. FIG. 6*b* shows an X-Y plane divergence field of the dipole antenna 100'. As shown in FIG. 6*b*, the dipole antenna 100' of the embodiment provides omnidirectional divergence fields.

Figure 7:
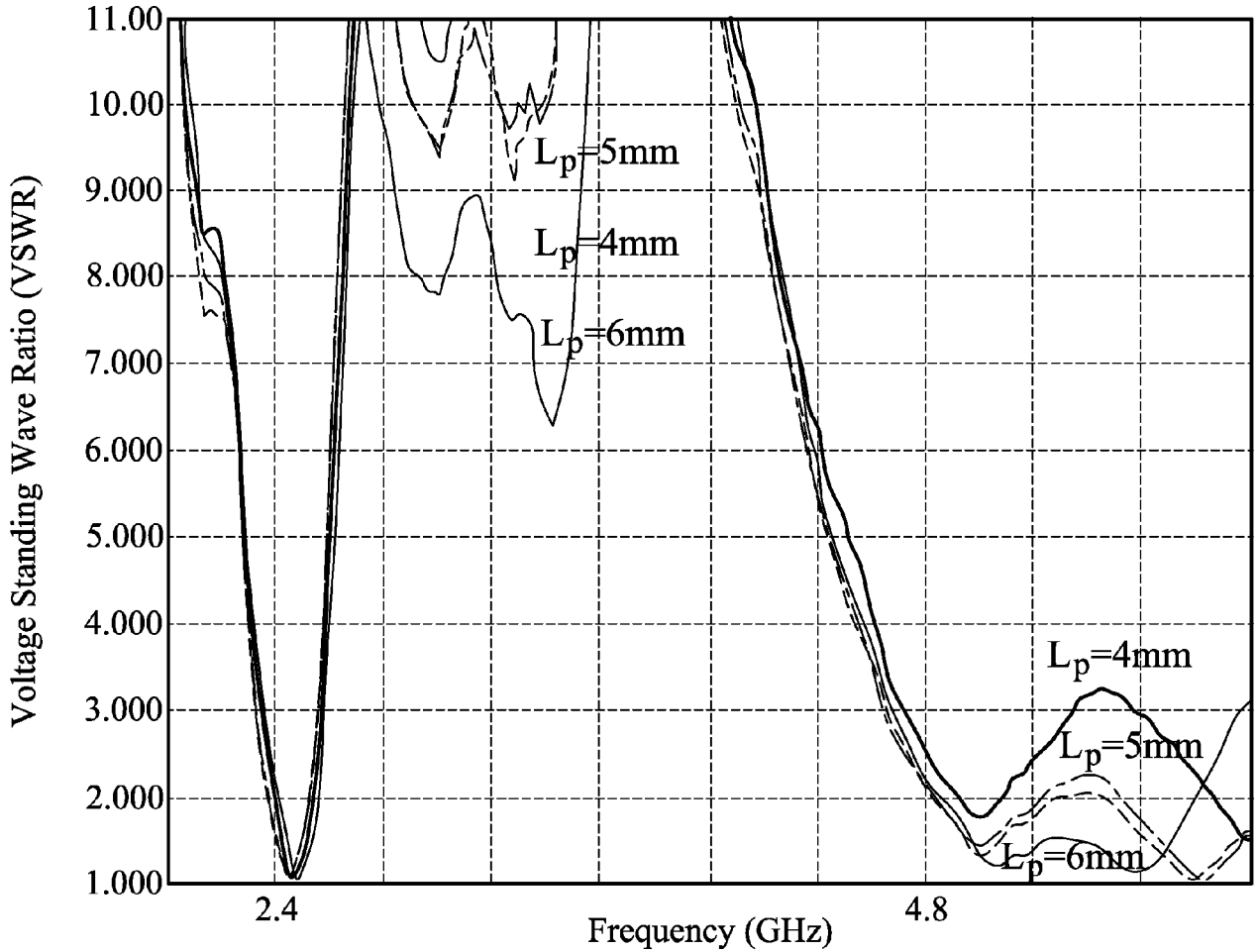
FIG. 7 shows the Voltage Standing Wave Ratio (VSWR) of the dipole antenna of the second embodiment under different lengths $L_p$ of the parasitical element.

FIG. 7 shows the Voltage Standing Wave Ratio (VSWR) of the dipole antenna under different lengths $L_p$ of the parasitical element 150. As shown in FIG. 7, signal transmission can be improved be changing the length $L_p$ of the parasitical element 150.

Figure 8:
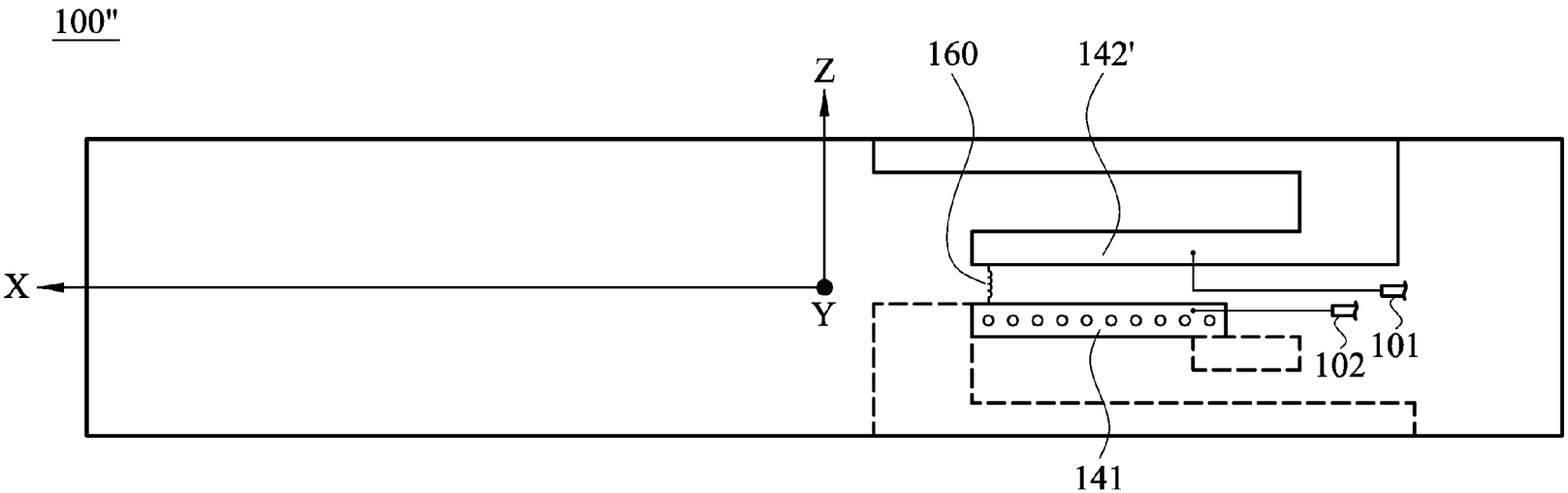
FIG. 8 shows a dipole antenna of a third embodiment of the invention.
Figure 9:
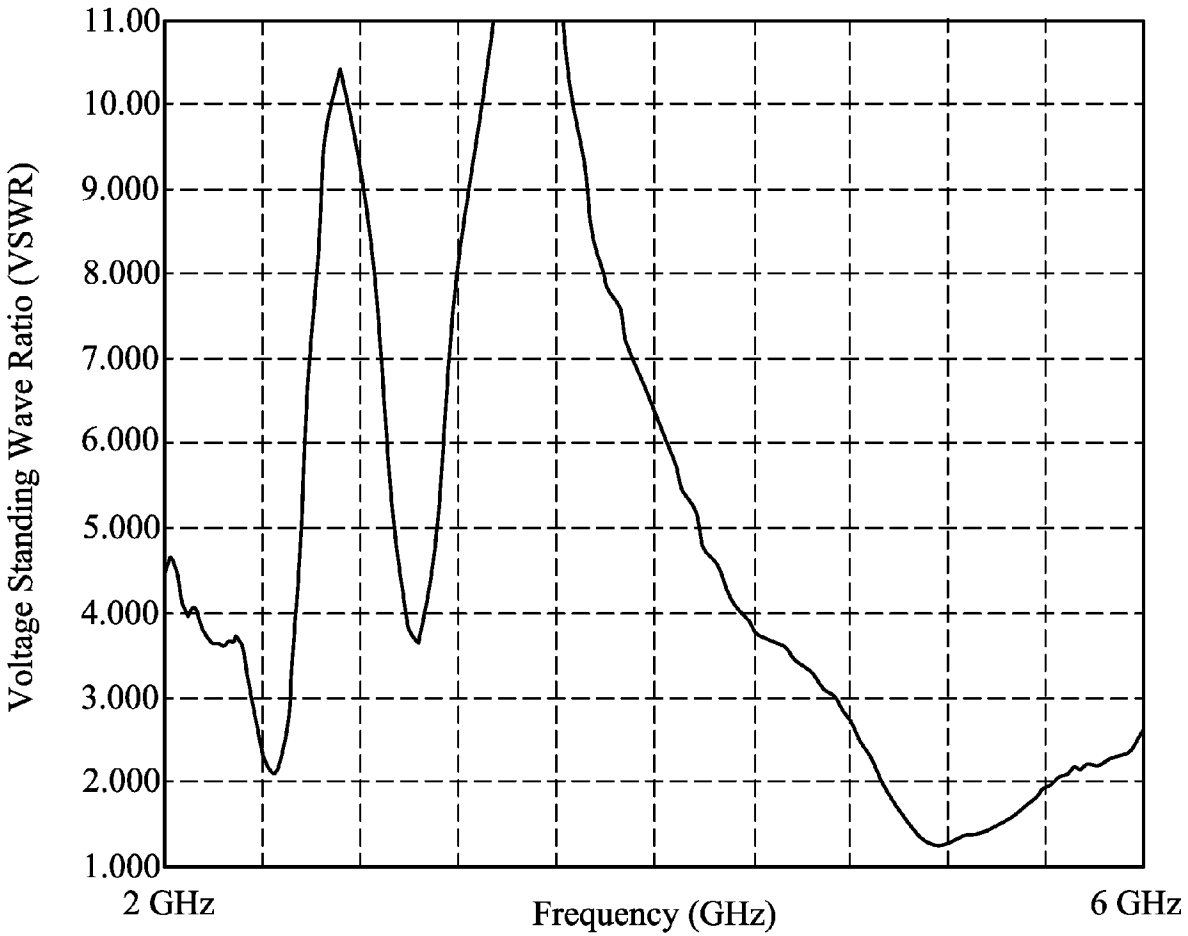
FIG. 9 shows the Voltage Standing Wave Ratio (VSWR) of the dipole antenna of the third embodiment.

FIG. 8 shows a dipole antenna 100" of a third embodiment of the invention, wherein the dipole antenna 100" comprises a passive element 160. The passive element 160 is electrically connected between the third connection portion 141 and the short element 142'. The passive element 160 is utilized for controlling resistance matching. In this embodiment, the passive element 160 is an inductance. FIG. 9 shows the Voltage Standing Wave Ratio (VSWR) of the dipole antenna 100".

Figure 10:
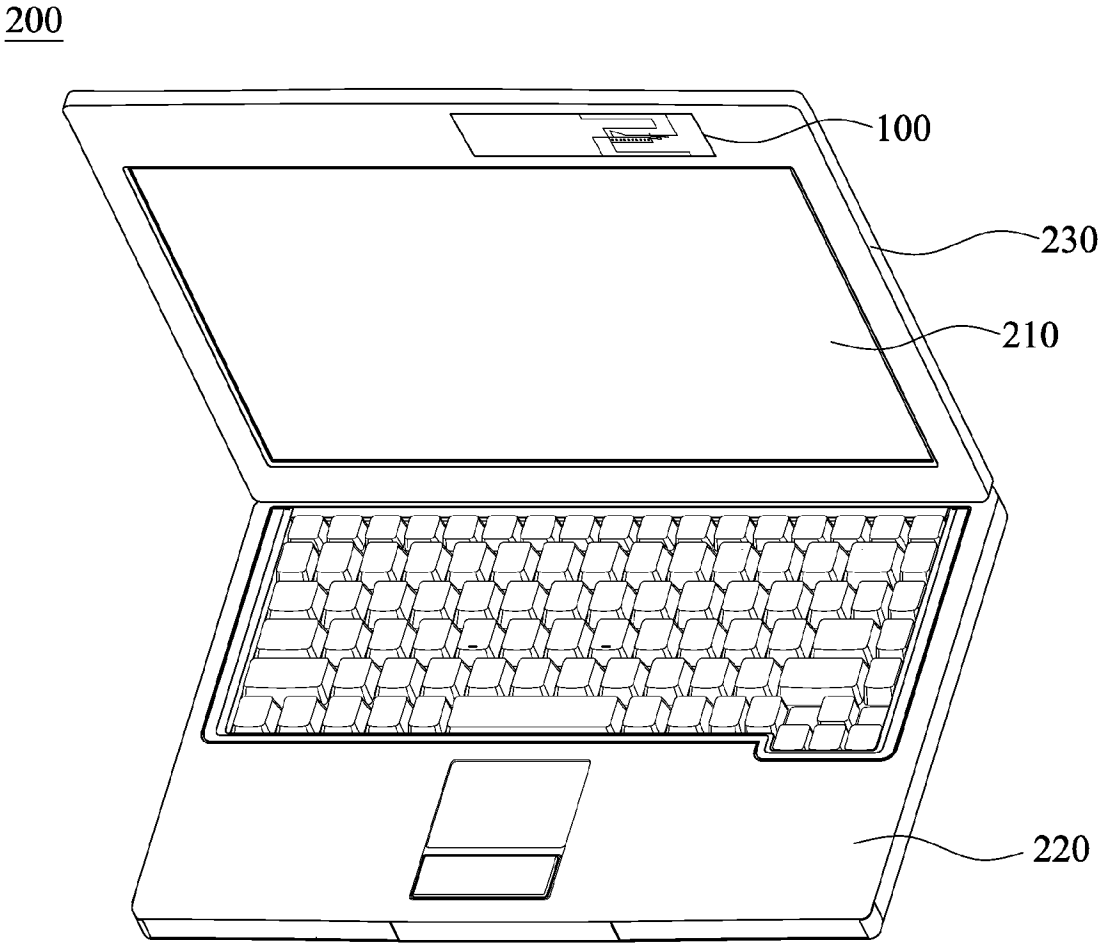
FIG. 10 shows a portable computer of an embodiment of the invention.

FIG. 10 shows a portable computer 200, comprising a display 210, a body 220 and a housing 230. The dipole antenna 100 of the embodiment is embedded in the housing 230. The display 210 is located between the dipole antenna 100 and the body 220.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dipole antenna, comprising:

a signal line;

a ground line;

a substrate, comprising a first surface and a second surface, wherein the first surface is opposite to the second surface;

a first radiation element, disposed on the first surface and electrically connected to the signal line, wherein the first radiation element comprises a first connection portion and a first extending portion, the first extending portion comprises a first bending portion, the first bending portion forms a first section and a second section on the first extending portion, and the first section is connected to the first connection portion; and a second radiation element, disposed on the second surface and electrically connected to the ground line, wherein the second radiation element comprises a second connection portion, wherein at least one hole is formed on the substrate, and the first connection portion and the second connection portion are electrically connected through the hole.

2. The dipole antenna as claimed in claim 1, wherein the second radiation element comprises a second extending portion, the second extending portion comprises a second bending portion, the second bending portion forms a third section and a fourth section on the second extending portion, the third section is connected to the second connection portion, and the second section is substantially parallel to the fourth section.

3. The dipole antenna as claimed in claim 2, wherein the first radiation element is U shaped and a first opening thereof faces a first opening direction, the second radiation element is U shaped and a second opening thereof faces a second opening direction, and the first opening direction is opposite to the second opening direction.

4. The dipole antenna as claimed in claim 3, wherein the first connection portion is parallel to the second connection portion.

5. The dipole antenna as claimed in claim 3, wherein the first section is parallel to the third section.

6. The dipole antenna as claimed in claim 3, wherein a shape of the first extending portion is substantially identical to a shape of the second extending portion.

7. The dipole antenna as claimed in claim 3, wherein a line width of the first section is greater than a line width of the second section, and a line width of the third section is greater than a line width of the fourth section.

8. The dipole antenna as claimed in claim 3, wherein the ground line is electrically connected to the second connection portion through the hole.

9. The dipole antenna as claimed in claim 8, further comprising a short element and a third connection portion, wherein the short element and the third connection portion are located on the first surface, the short element is connected to the first connection portion and the third connection portion, the third connection portion corresponds to the second connection portion, the third connection portion is electrically connected to the second connection portion through the hole, the ground line is connected to the third connection portion, and a groove is formed between the third connection portion and the short element.

10. The dipole antenna as claimed in claim 9, wherein a recess is formed on the short element and located on an edge of the groove.

11. The dipole antenna as claimed in claim 10, wherein the edge of the short element has a hypotenuse to form the recess.

12. The dipole antenna as claimed in claim 9, further comprising a parasitical element, wherein the parasitical element is located on the second surface, and connected to the second connection portion.

13. The dipole antenna as claimed in claim 8, further comprising a short element, a passive element and a third connection portion, wherein the short element, the passive element and the third connection portion are located on the first surface, the short element is connected to the first connection portion, the passive element is connected between the short element and the third connection portion, the third connection portion corresponds to the second connection portion, the third connection portion is electrically connected to the second connection portion through the hole, and the ground line is connected to the third connection portion.

14. The dipole antenna as claimed in claim 13, wherein a groove is formed between the third connection portion and the short element.

15. The dipole antenna as claimed in claim 13, wherein the passive element is an inductance.

16. A portable computer, comprising:

a display;

a body; and a dipole antenna, wherein the display is disposed between the body and the dipole antenna, and the dipole antenna comprises:

a signal line;

a ground line;

a substrate, comprising a first surface and a second surface, wherein the first surface is opposite to the second surface;

a first radiation element, disposed on the first surface and electrically connected to the signal line, wherein the first radiation element comprises a first connection portion and a first extending portion, the first extending portion comprises a first bending portion, the first bending portion forms a first section and a second section on the first extending portion, and the first section is connected to the first connection portion; and a second radiation element, disposed on the second surface and electrically connected to the ground line, wherein the second radiation element comprises a second connection portion, wherein the second radiation element comprises a second extending portion, the second extending portion comprises a second bending portion, the second bending portion forms a third section and a fourth section on the second extending portion, the third section is connected to the second connection portion, and the second section is substantially parallel to the fourth section, wherein the first radiation element is U shaped and a first opening thereof faces a first opening direction, the second radiation element is U shaped and a second opening thereof faces a second opening direction, and the first opening direction is opposite to the second opening direction, wherein the dipole antenna further comprises a short element and a third connection portion, the short element and the third connection portion are located on the first surface, the short element is connected to the first connection portion and the third connection portion, the third connection portion corresponds to the second connection portion, the third connection portion is electrically connected to the second connection portion through the hole, the ground line is connected to the third connection portion, and a groove is formed between the third connection portion and the short element.

17. The portable computer as claimed in claim 16, wherein a recess is formed on the short element and located on an edge of the groove.

18. The portable computer as claimed in claim 17, wherein the recess is triangular.

19. A dipole antenna, comprising:

a signal line;

a ground line;

a substrate, comprising a first surface and a second surface, wherein the first surface is opposite to the second surface;

a first radiation element, disposed on the first surface and electrically connected to the signal line, wherein the first radiation element comprises a first connection portion; and a second radiation element, disposed on the second surface and electrically connected to the ground line, wherein the second radiation element comprises a second connection portion, wherein a hole is formed on the substrate, and the first connection portion and the second connection portion are electrically connected through the hole.

20. The dipole antenna as claimed in claim 19, further comprising a short element and a third connection portion, wherein the short element and the third connection portion are located on the first surface, the short element is connected to the first connection portion and the third connection portion, the third connection portion corresponds to the second connection portion, the third connection portion is electrically connected to the second connection portion through the hole, the ground line is connected to the third connection portion, and a groove is formed between the third connection portion and the short element.

21. A portable computer, comprising:

a display;

a body; and a dipole antenna, wherein the display is disposed between the body and the dipole antenna, and the dipole antenna comprises:

a signal line;

a ground line;

a substrate, comprising a first surface and a second surface, wherein the first surface is opposite to the second surface;

a first radiation element, disposed on the first surface and electrically connected to the signal line, wherein the first radiation element comprises a first connection portion and a first extending portion, the first extending portion comprises a first bending portion, the first bending portion forms a first section and a second section on the first extending portion, and the first section is connected to the first connection portion; and a second radiation element, disposed on the second surface and electrically connected to the ground line, wherein the second radiation element comprises a second connection portion, wherein the second radiation element comprises a second extending portion, the second extending portion comprises a second bending portion, the second bending portion forms a third section and a fourth section on the second extending portion, the third section is connected to the second connection portion, and the second section is substantially parallel to the fourth section, wherein the first radiation element is U shaped and a first opening thereof faces a first opening direction, the second radiation element is U shaped and a second opening thereof faces a second opening direction, and the first opening direction is opposite to the second opening direction, wherein the dipole antenna further comprises a short element, a passive element and a third connection portion, wherein the short element, the passive element and the third connection portion are located on the first surface, the short element is connected to the first connection portion, the passive element is connected between the short element and the third connection portion, the third connection portion corresponds to the second connection portion, the third connection portion is electrically connected to the second connection portion through the hole, and the ground line is connected to the third connection portion.

22. The portable computer as claimed in claim 21, wherein a groove is formed between the third connection portion and the short element, and the passive element is an inductance.

* * * * *